United States Patent [19]

Tomura

[11] 4,148,591

[45] Apr. 10, 1979

[54] WRITING UNIT LOCKING MECHANISM IN A MULTIPLE-POINT WRITING IMPLEMENT INCLUDING A MECHANICAL PENCIL UNIT

[75] Inventor: Yoshihiro Tomura, Omiya, Japan

[73] Assignee: Pilot Man-Nen-Hitsu Kabushiki Kaisha, Tokyo, Japan

[21] Appl. No.: 824,303

[22] Filed: Aug. 12, 1977

[51] Int. Cl.[2] ..... B43K 27/12

[52] U.S. Cl. ..... 401/32; 401/17

[58] Field of Search ..... 401/17, 19, 20, 21, 401/29, 32, 33

[56] References Cited

U.S. PATENT DOCUMENTS

| | | | |
|---|---|---|---|
| 2,505,267 | 4/1950 | Weber | 401/17 |
| 2,882,859 | 4/1959 | Poritz | 401/29 |
| 3,152,578 | 10/1964 | Hofmann | 401/33 |
| 3,174,462 | 3/1965 | Bross | 401/33 |
| 4,022,535 | 5/1977 | Ritter | 401/32 |

FOREIGN PATENT DOCUMENTS

| | | | |
|---|---|---|---|
| 1561838 | 3/1967 | Fed. Rep. of Germany | 401/32 |
| 1611793 | 3/1968 | Fed. Rep. of Germany | 401/32 |
| 2137469 | 7/1971 | Fed. Rep. of Germany | 401/33 |
| 48-4354 | 2/1973 | Japan | 401/32 |

*Primary Examiner*—Edward M. Coven

*Attorney, Agent, or Firm*—Wenderoth, Lind & Ponack

[57] ABSTRACT

A writing unit locking mechanism in a writing implement having a mechanical pencil unit and a ball point pen unit both housed in a single holder cylinder. The locking mechanism has a writing unit selection member having a shift member shiftable under gravitational force to select one or the other writing unit and operated manually to actuate a chuck in the pencil unit and a catch shoulder provided on a unit cylinder of the pencil unit and adapted to engage directly with the holder cylinder or with an engagement member resiliently supported on the holder cylinder thereby to lock the pencil unit in its writing position. The pencil unit is released from its locked state simultaneously with the release of the selection member.

8 Claims, 7 Drawing Figures

WRITING UNIT LOCKING MECHANISM IN A MULTIPLE-POINT WRITING IMPLEMENT INCLUDING A MECHANICAL PENCIL UNIT

BACKGROUND OF THE INVENTION

This invention relates generally to writing implements such as ball point pens and mechanical pencils and more particularly to a writing unit locking mechanism in a multiple-point writing implement including a mechanical pencil unit.

More specifically, the invention relates to a writing unit locking device in a multiple-point writing implement comprising a mechanical pencil unit in which a chuck connectable with a unit cylinder travels along the axis of the unit cylinder thereby to feed a pencil lead out of the unit cylinder, at least one other writing unit such as, for example, a ball point pen unit, a single holder cylinder for accommodating the pencil unit and the other writing unit, and a writing unit selection member for selecting any of the writing units as desired.

A great problem encountered in the design of a multiple-point writing implement of this kind has been the provision, together with a simple and expedient mechanism for selecting writing units, of a simple and convenient mechanism for locking each of the writing units in its writing position in relation with the writing unit selection mechanism. Particularly in the case of a mechanical pencil, a requirement is that, when it is in its writing position and it is necessary to feed pencil lead out of it, it must remain in its writing position. For this reason, the provision of a simple and convenient locking mechanism has been desired.

Another requirement in a mechanical pencil unit of the instant kind is that the force with which the chuck part holds the pencil lead be increased in order to resist the writing force imparted to the pencil lead. Accordingly, a simple and convenient solution for this requirement is also desired.

SUMMARY OF THE INVENTION

It is an object of this invention to provide a multiple-point writing implement including a mechanical pencil in which the above described requirements are met by a writing unit locking device having a simple construction.

In the multiple-point writing implement according to this invention, a desired writing unit is selected by means of a shifting member movable by gravitational force, whereby each of the writing units can be placed in its writing position in a simple and convenient manner, and a catch part is formed on a unit cylinder of the mechanical pencil and caused to engage directly or indirectly with the holder cylinder of the implement in a writing cylinder. By these provisions, the locking of the mechanical pencil unit in the writing position can be simply attained, and, at the same time, the pencil lead holding force is increased by this locking mechanism so that it can withstand a relatively large writing force.

According to this invention, briefly summarized, there is provided, in a multiple-point writing implement comprising a mechanical pencil unit having a unit cylinder and a chuck adapted to connect with the unit cylinder and to shift along the axis thereof thereby to feed a pencil lead out of the unit cylinder, at least one other writing unit, a single holder cylinder for accommodating the pencil unit and the other writing unit, and a pressing member to be pressed to select one of the writing units, and to move the same into the writing position thereof wherein the writing end thereof projects out of the writing end of the holder cylinder, an improved writing unit locking mechanism comprising a writing unit selection means having a writing unit push member movable within the holder cylinder under gravitational force to select one of the writing units and operated manually to actuate the chuck, said mechanism further comprising engagement means on the holder cylinder, a catch shoulder provided on the unit cylinder and adapted to engage with said engagement means thereby to lock the pencil unit in the writing position thereof, and means for causing release of the pencil unit from the locked state thereof simultaneously with that of the writing unit selection means.

The nature, utility, and further features of this invention will be apparent from the following detailed description with respect to preferred embodiments of the invention when read in conjunction with the accompanying drawings, which are briefly described below, and throughout which like parts are designated by like reference numerals and characters.

BRIEF DESCRIPTION OF THE INVENTION

DETAILED DESCRIPTION

Figure 1:
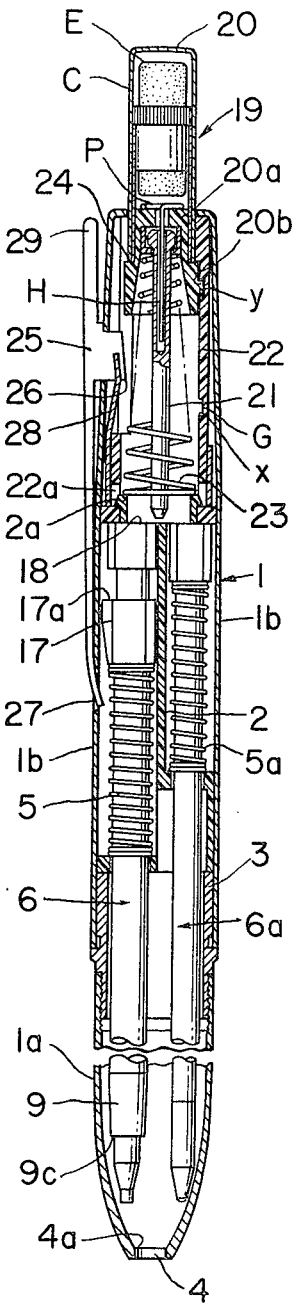
FIG. 1 is a side view, with parts cut away and parts shown in longitudinal section, showing a multiple-point writing implement in which an embodiment of this invention is incorporated.

Referring first to FIG. 1 showing the essential construction of one example of a writing implement according to this invention, the writing implement has a holder cylinder 1 constituting an outer housing and accommodating therein a mechanical pencil unit 6 and a ball point pen unit 6*a* disposed side-by-side separated by a case partition 2 interposed therebetween. The holder cylinder comprises a front cylinder 1*a* and a rear cylinder 1*b*, which are connected coaxially by a threaded cylinder 3. The threaded cylinder 3 is fixedly secured to the rear cylinder 1*b*, and the front cylinder 1*a* is detachably screwed onto the threaded cylinder 3. The threaded cylinder may be replaced by any other member which can detachably hold the front cylinder 1*a*.

The front cylinder 1*a* has a bullet-like front end, at the extreme front tip of which an aperture 4 is defined and encompassed by a rim formed by the front cylinder. This rim is shaped to have a stop part 4*a* against which a stepped shoulder 9*c* of the mechanical pencil unit 6 described hereinafter abuts. Coil springs 5 and 5a are respectively provided around parts of the mechanical pencil unit (hereinafter referred to as the "pencil unit") 6 and the ball point pen unit (hereinafter referred to the "pen unit") 6a and resiliently urge the respective units 6 and 6a axially toward the rear of the holder cylinder 1. The resilient force exerted by the coil spring 5 on the pencil unit 6 is less than the force of a coil spring 15 (FIG. 4) installed within the pencil unit 6 and described hereinafter.

Figure 4:
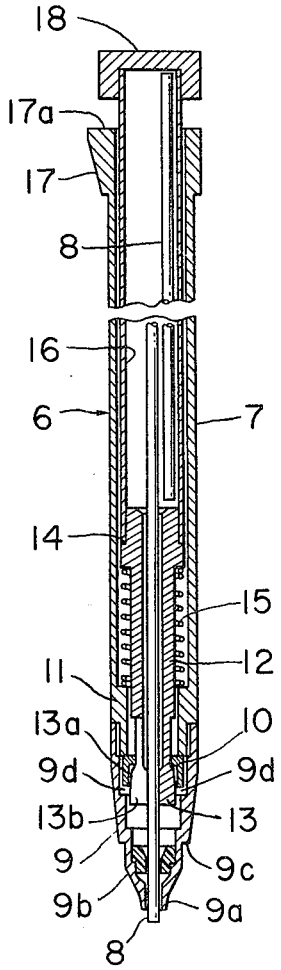
FIG. 4 is a relatively enlarged side view, with parts cut away and parts shown in longitudinal section, showing an example of the construction of a mechanical pencil unit.

The pencil unit 6 will now be described in greater detail in conjunction with FIG. 4. The pencil unit 6 has a unit cylinder 7 constituting an outer housing and having at its forward end a nose cover 9 secured thereto and having a therethrough hole 9a through which a pencil "lead" S is thrust outward for writing. Within the nose cover 9 is fixed a holding member 9b for holding the pencil lead 8, and outside of this holding member 9b, the aforementioned stepped shoulder 9c is formed and functions to abut against the stop part 4a provided at the forward tip of the front cylinder 1a as described briefly hereinbefore.

Within the unit cylinder 7, a tightening tube 10 is provided and adapted to shift longitudinally between a stepped part 9d of the nose cover 9 and one end face of a stepped part 11 of the unit cylinder 7. A chuck 12 is so provided having a tapered part 13a with longitudinal slits 13b formed therein contacting the inner wall surface of the tightening tube 10. The chuck 12 is positioned in a position wherein it is resiliently urged toward the rear end of the unit cylinder 7 by the aforementioned coil spring 15 positioned between the stepped part 11 of the unit cylinder 7 and a stepped part 14 of the chuck 12 and is normally in closed state. The spring force of the coil spring 15 is greater than that of the aforementioned coil spring 5 installed within the holder cylinder 1.

Into the rear half of the unit cylinder 7 is slidably inserted a lead reserve tube 16 for accommodating spare pencil leads. The front end of this lead reserve tube 16 abuts against the stepped part 14 of the chuck 12, while the rear end of this tube 16 is closed by a tail cap 18. Thus, this lead reserve tube 16 is slidably fitted in the unit cylinder 7 so as to be in abutting contact with the chuck 12 when acted on by a spring force.

The unit cylinder 7 is provided at its rear end with a lateral projection 17, on which is formed a catch shoulder 17a of the pencil unit 6. This catch shoulder 17a is adapted to engage with a second engagement part 27 of an elongated engagement member 25 secured to the rear cylinder 1b by a resilient member 28 which exerts a counterlockwise turning force on the engagement member 25 as viewed in FIG. 1.

Figure 5:
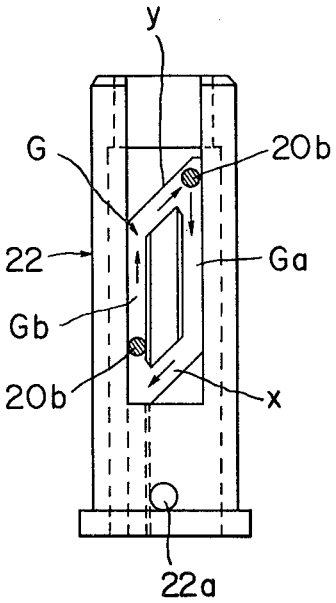
FIG. 5 is an enlarged side view showing the relationship between a knob guide path and a knob in an example of the locking mechanism of the invention.

An inner sleeve 22 is fitted in the rear cylinder 1b and is provided with a guide path defining means defining a guide path G for guiding a knob 20. The guide path G has two spaced parallel grooves Ga and Gb extending in the longitudinal direction in the inner wall surface of the inner sleeve 22, a forwardly oblique path x, and a rearwardly oblique path y, the paths x and y being mutually parallel and connected at their ends to the respective ends of the grooves Ga and Gb thereby to form the guide path G having parallelogrammatic shape as shown in FIG. 5. The inner sleeve 22 is provided near its forward end with a hole 22a for engagement with an end part 2a of the case 2 thereby to fix the inner sleeve 22 in the rear cylinder 1b.

A unit selection member 19 is provided at the rear end of the rear cylinder 1b and comprises the above mentioned knob 20 having a projecting lug 20b adapted to slide in and along the guide path G and a push rod 21 engaged in a loose-fit state with the forward end part 20a of the knob and adapted to shift in accordance with gravitational force. This unit selection member 19 is normally urged rearward within the inner sleeve 22 by the elastic force of a spring 23 disposed around the push rod 21. The knob 20 is in the shape of a hollow structure with a rear cap C and can accommodate an eraser E therewithin. An elongated longitudinal recess H is formed in the push rod 21 so as to communicate with the interior of the knob 20 and serves to accommodate a needle P for removing foreign matter from the pencil unit.

In the instant embodiment of this invention, the push rod 21 is a member which shifts in accordance with gravitational force, but almost any suitable mechanism can be used instead provided it can function as a medium for transmitting pressing force from the knob 20 to the writing units 6 and 6a. For example, a mechanical arrangement wherein a ball capable of moving under gravitational force within a specific region can by provided and adapted to transmit pressing force from the knob 20 appropriately to either of the writing units 6 and 6a.

A stepped catch part 24 for locking the unit selection member 19 is formed on the forward end part 20a of the knob 20. This catch part 24 engages with a first engagement part 26 when the forward end of the pencil unit 6 or the pen unit 6a is advanced so as to project through the aperture 4 of the holder cylinder 1. When the pencil unit 6 is shifted forward to so that its forward end projects out of the holder cylinder 1, the catch shoulder 17a of the pencil unit engages with the second engagement part 27 of the engagement member 25 and, substantially simultaneously with the engagement of the catch part 24 with the first engagement part 26 of the engagement member.

As described above, the engagement member 25 has the first engagement part 26 for engaging with the catch part 24 of the unit selection member 19 and the second engagement part 27 for engaging with the catch shoulder 17a of the pencil unit 6 and is elastically urged in the axial direction of the holder cylinder 1 and is mounted on the rear cylinder 1b in a manner such that it can be rotated in the clockwise direction (i.e., the direction of the arrow in (FIG. 2) by the resilient member 28 in the rear cylinder 1b. The second engagement part 27 extends into and is hidden in the interior of the rear cylinder 1b. The engagement member 25 is provided at its rear part with a projecting extension 29.

Figure 3:
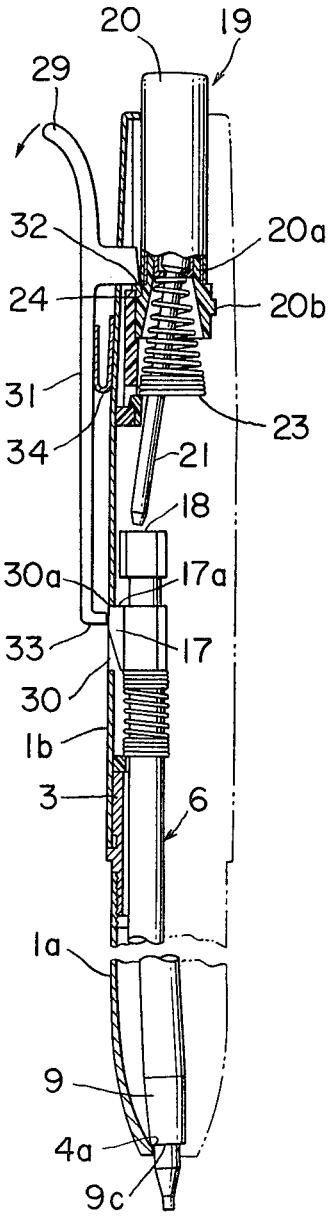
FIG. 3 is a side view showing another embodiment of the invention and showing the mechanical pencil in its writing position.

A different mechanism for locking the pencil unit 6 in the position for writing i.e. with the pencil lead projecting wherein the catch shoulder 17a of the pencil unit is engaged with the rear cylinder 1b itself is shown in FIG. 3. The catch shoulder 17a of the pencil unit is abutting against the rear edge surface 30a of a slot 30 formed in the rear cylinder 1b and is locked. In this case, the diameter of the catch shoulder 17a is made slightly greater than that in the preceding example to an extent such that, when it reaches the slot 30, it will press against the inner surface of the rear cylinder 1b.

Furthermore, the engagement member 31 in this example has a first engagement part 32 for engaging the catch part 24 of the unit selection member 19 and a projection 33 for abutting against the projection 17 of the unit cylinder 7 having the catch shoulder 17*a* of the pencil unit 6. This engagement member 31 is mounted on the rear cylinder 1*b* in a manner permitting its rotation in the counterclockwise direction (direction of the arrow in FIG. 3) by a resilient member 34 which imparts a resilient force to the engagement member 31 tending to turn projection 33 toward the axis of the holder cylinder.

The mechanism having the above described construction according to this invention operates as follows. Since the push rod 21 of the unit selecting member 19 moves under the force of gravity, when the holder cylinder 1 is grasped and the knob 20 is pushed forward so that the push rod 21 arrives at a position where it abuts the tail cap 18 of the pencil unit 6, the nose cover 9 of the pencil unit is projected out through the aperture 4 of the holder cylinder 1. At this time, the projecting lug 20*b* on the knob 20 moves along the groove Ga and, eventually passing through the forwardly oblique path x, reaches the groove Gb.

Figure 6B:
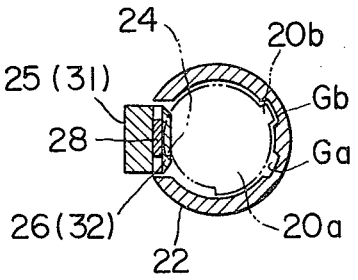
FIGS. 6 A and 6 B are cross sections showing different states and showing the relationship between a first engagement part of an engagement member and a catch part of a writing unit selection member in relation to FIG. 5.
Figure 6A:
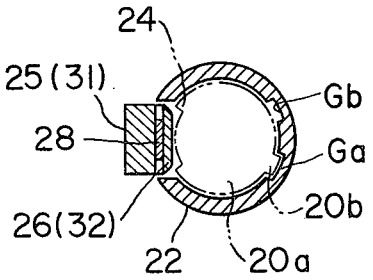

In this operational step, the knob 20 rotates, and since the catch part 24 is disposed at the position of the forward end part 20*a* of the knob at the time when the projecting lug 20*b* reaches the groove Gb, when the pressing force is removed at this time, the catch part 24 engages the first engagement part 26 or 32 of the engagement member 25 or 31 (FIGS. 6 A and 6 B). At the same time, the catch shoulder 17*a* of the pencil unit 6 engages with the second engagement part 27 of the engagement member 25 (FIG. 2) or the rear edge surface 30*a* of the slot 30 in the rear cylinder 1*b* (FIG. 3). Accordingly, in accordance with this invention, the outer peripheral surface of the end part 20*a* does not contact the engagement member 25 when the knob 20 is pressed, except for the engagement of the catch part 24 with the first engagement part 26, whereby the action of the unit selection member 19 is very smooth.

In this manner, the pencil unit 6 is placed in its writing position. When, with the pencil unit 6 in this position, it is necessary to feed the pencil lead 8 forward, the unit selection member 19 is pressed, whereupon the push rod 21 pushes the tail cap 18 of the pencil unit 6, and the pencil lead 8 is fed out through the nose cover 9.

This action will now be described in greater detail with reference to FIGS. 2, 3, and 4. As a consequence of the pushing of the push rod 21, the stepped shoulder 9*c* of the nose cover 9 abuts the stop part 4*a* of the front cylinder 1*a*. Furthermore, the chuck 12 joining the lead containing tube 16, the pencil lead 8, and the tightening tube 10 move longitudinally toward the nose cover 9 until the tightening tube 10 finally abuts the stepped part 9*d* of the nose cover 9. Then, the tapered part 13*a* of the chuck part 13 separates from the inner wall surface of the tightening tube 10, whereupon the chuck part 13 opens, and the pencil lead is fed forward.

When the unit selection member released, the chuck 12 is returned to its original state by the force of the spring 15. As a consequence, the tapered part 13*a* of the chuck part 13 again engages with the inner wall surface of the tightening tube 10 and thereby positively grips the pencil lead. By repeating this operation, the pencil lead can be fed progressively out of the nose cover 9.

When the pen unit 6*a* is to be placed in the writing state, the holder cylinder 1 is so held by hand that the push rod 21, which shifts under the force of gravity, is brought into the position for abutting against the rear end of the pen unit 6*a*. Then, when the knob 20 is pushed forward, the nose end of the pen unit 6*a* is projected out through the aperture 4 of the front cylinder 1*a* similarly as in the case where the pencil unit 6 is projected. The catch part 24 of the unit selection member 19 engages with the first engagement part 26 (or 32) of the engagement member 25 (or 31), and the implement is thus placed in position for writing with the pen unit 6*a*.

From its forwardly projected writing position, the pencil unit 6 or the pen unit 6*a* is retracted into the holder cylinder 1 in the following manner. In the case where pencil unit 6 has been placed in its writing position by the engagement of the catch shoulder 17*a* of the pencil unit 6 with the rear cylinder 1*b* itself, the projecting extension 29 of the engagement member 31 is turned counterclockwise as viewed in FIG. 3, whereupon the first engagement part 32 disengages from the catch part 24 of the unit selection member 19. (In the case of the pen unit 6*a*, the pen unit 6*a* is retracted by only this procedure.) At the same time, the projection 33 pushes the projection 17 provided on the unit cylinder 7 of the pencil unit 6, and the catch shoulder 17*a* of the projection 17 is disengaged from the slot 30 in the holder cylinder simultaneously with the catch part 24 of the unit selection member 19 (FIG. 3).

Figure 2:
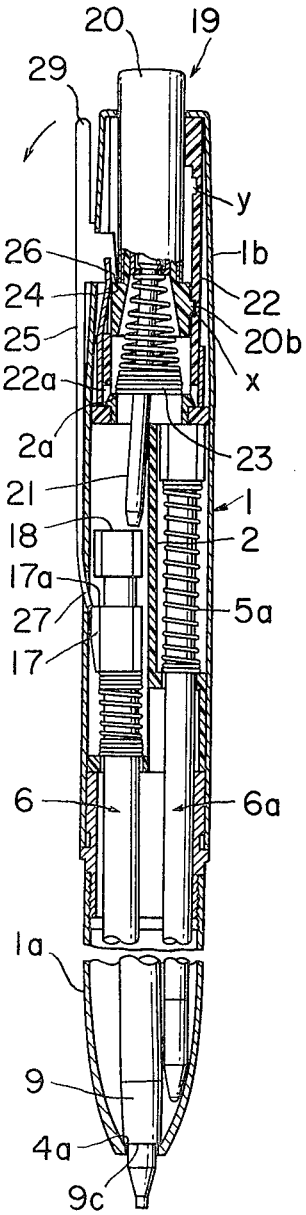
FIG. 2 is a side view of the writing implement illustrated in FIG. 1 with a mechanical pencil unit in its writing position.

When the writing position is established by the engagement of the catch shoulder of the pencil unit 6 with the engagement member 25 provided on the rear cylinder 1*b*, the extension 29 of the engagement member 25 is manually turned clockwise as viewed in FIG. 2 against the resiliency of the member 28, whereupon the first engagement part 26 and the second engagement part 27 are simultaneously released from their engagement respectively from the catch part 24 of the unit selection member 19 and the catch shoulder 17*a* of the pencil unit 6. As a consequence, the projecting lug 20*b* of the knob 20 slides along the groove Gb and, eventually passing through the rearwardly oblique path y, returns to its original position, and the tip part of the pencil unit 6 is retracted into the front cylinder 1*a*. The retraction of the pen unit 6*a* is effected by only the disengagement of the first engagement part 26 and the catch part 24 similarly as in the preceding embodiment of this invention.

By the construction and operation of the writing implement of this invention as described above, each writing unit can be placed in its writing position in a simple and convenient manner by means of the unit selection member. A particularly unique feature is that the writing position of the pencil unit 6 is maintained by the engagement of the catch shoulder formed on the unit cylinder, which is subjected to the writing force, with the holder cylinder itself or the engagement member provided integrally with the holder cylinder. Accordingly, the action of feeding out the pencil lead by means of the unit selection member, which has also placed the pencil unit 6 in the writing position becomes possible. Furthermore, even with a relatively large writing force, the engagement between the inner wall surface of the tightening tube and the tapered part of the chuck is made even more tight, whereby an increase in the force with which the pencil lead is held by the chuck part is achieved in a simple manner.

I claim:

1. A multiple-point writing implement comprising, in combination:

a holder cylinder having a forward aperture and a rear end;

a mechanical pencil unit with a writing end movably positioned in said holder cylinder for movement between a normal retracted position and an advanced writing position wherein said writing end projects out of said forward aperture of the holder cylinder, said pencil unil having a unit cylinder and a chuck disposed in the unit cylinder for normally chucking a writing lead;

means for making said chuck inoperative for releasing the lead from the chuck to feed it out of the unit cylinder, said means having tail means fixedly connected to said chuck within said unit cylinder and operable to make the chuck inoperative only when it is pushed toward said writing end of the pencil unit while the pencil unit is held stationary in said writing position;

a catch shoulder provided on said unit cylinder of the pencil unit:

at least one other writing unit with a writing end, provided in said holder cylinder in substantially parallel relationship with said pencil unit and movable between a normal retracted position and an advanced writing position wherein the writing end thereof projects out of said aperture of the holder cylinder;

writing unit selection means provided at said rear end of the holder cylinder and movably mounted for movement out of the holder cylinder and having a writing unit push member movable within the holder cylinder between positions in which it is opposed to the respective units, said writing unit push member being engagable with a selected unit for pushing the selected unit to the writing position thereof when the writing unit selection means is moved into the holder cylinder;

catch means on said writing unit selection means;

first engagement means in a position for engaging said catch means to arrest and hold the writing unit selection means near the position of the selection means to which the selection means has been pushed to shift the selected unit to the writing position thereof;

second engagement means in a position for engaging said catch shoulder on said pencil unit when said pencil unit is in the writing position to arrest and hold the pencil unit in that position; and manually operable means operably associated with said first and second engagement means outside the holder cylinder for simultaneously disengaging the first and second engagement means and the catch means and catch shoulder, respectively, when the manually operated means is operated, thereby to allow the selected unit to return to its retracted position.

2. A multiple-point writing implement as claimed in claim 1, wherein said writing unit selection means has a knob movable into and out of the holder cylinder and with a lateral projecting lug thereon, and the holder cylinder has a parallelogram-shaped guide path in which said lug engages, said guide path having two spaced substantially parallel grooves extending axially of the holder cylinder and two oblique portions respectively joining the ends of the grooves, whereby when the knob is pressed into the holder cylinder, it rotates about the axis thereof to an angular position where the catch means on the writing unit selection means is engagable with said first engagement means.

3. A multiple-point writing implement as claimed in claim 2, wherein said holder cylinder has a sleeve fixed therein and said guide path is in the inner wall of said sleeve.

4. A multiple-point writing implement as claimed in claim 1, wherein said manually operable means is an elongated engagement member resiliently secured to the holder cylinder and having said first engagement means at one part thereof and said second engagement means at another part thereof, whereby when the engagement member is manipulated, the two engagement means are moved simultaneously for disengagement from said catch means and catch shoulder, respectively.

5. A multiple-point writing implement as claimed in claim 4, wherein said first engagement means projects into the interior of the holder cylinder, and said catch means is a stepped catch part on said selection means within the interior of the holder cylinder, and wherein said holder cylinder has a hole therein and said second engagement means projects into the interior of the holder cylinder through said hole.

6. A multiple-point writing implement as claimed in claim 1, wherein said manually operable means is an elongaged engagement member resiliently secured to the holder cylinder and having said first engagement means at a part thereof, and said holder cylinder has a slot in the wall thereof, said second engagement means being an edge surface of said slot, and wherein said engagement member has a projection at another part thereof at a position movable into said slot for disengagement of said catch shoulder from the edge surface, whereby when the engagement member is manipulated, disengagement of said catch means and catch shoulder is effected simultaneously.

7. A multiple-point writing implement as claimed in claim 1, wherein said holder cylinder has a stop part at the rim of the forward operative, and the pencil unit has a stepped shoulder near the writing end thereof and adapted to abut against said stop part when the pencil unit is in the writing position when said tail means is pushed toward the writing end of the pencil unit.

8. A multiple-point writing implement as claimed in claim 1, wherein said writing unit selection means has a hollow cylinderical knob movable into and out of the holder cylinder, said knob having a detachably fitted rear cap thereon, and said push member is a push rod loosely fitted at one end thereof in a forward end part of the knob and having a central axial recess therein communicating with the interior of the knob, and a needle accomodated in said recess for removing foreign matter from the pencil unit.

* * * * *